US011559093B2

(12) United States Patent
Morales

(10) Patent No.: US 11,559,093 B2
(45) Date of Patent: Jan. 24, 2023

(54) PANTS WITH RIP-STOP AND MECHANICAL STRETCH

(71) Applicant: 5.11, Inc., Irvine, CA (US)

(72) Inventor: Francisco J. Morales, Newport Beach, CA (US)

(73) Assignee: 5.11, INC., Irvine, CA (US)

( * ) Notice: Subject to any disclaimer, the term of this patent is extended or adjusted under 35 U.S.C. 154(b) by 0 days.

(21) Appl. No.: 15/464,179

(22) Filed: Mar. 20, 2017

(65) Prior Publication Data

US 2017/0231303 A1 Aug. 17, 2017

Related U.S. Application Data

(63) Continuation of application No. 13/602,745, filed on Sep. 4, 2012, now Pat. No. 9,637,845.
(Continued)

(51) Int. Cl.
*A41D 29/00* (2006.01)
*A41D 31/24* (2019.01)
(Continued)

(52) U.S. Cl.
CPC ..... *A41D 29/00* (2013.01); *A41B 1/08* (2013.01); *A41D 1/06* (2013.01); *A41D 31/24* (2019.02); *D03D 1/00* (2013.01); *D03D 13/004* (2013.01); *D03D 15/47* (2021.01); *D03D 15/56* (2021.01); *D06B 1/00* (2013.01); *A41D 2500/20* (2013.01); *A41D 2600/20* (2013.01); *D10B 2201/02* (2013.01); *D10B 2201/20* (2013.01); *D10B 2331/04* (2013.01); *D10B 2501/04* (2013.01); *D10B 2507/00* (2013.01); *Y10T 442/3065* (2015.04)

(58) Field of Classification Search
CPC ..... A41D 13/0015; A41D 13/02; A41D 7/00; A41D 13/015; A41D 13/065; A41D 1/06; A41D 2300/22; A41D 1/08; A41D 2300/32; A41D 2300/322; A41D 2300/324; A41D 2300/326; A41D 29/00; A41D 31/055; A41B 1/08; D03D 17/00
USPC ..... 2/69, 224, 456, 227; 442/182
See application file for complete search history.

(56) References Cited

U.S. PATENT DOCUMENTS 3,452,411 A * 7/1969 Brown ..... D02G 3/328 139/421
4,636,426 A 1/1987 Fleischer
(Continued)

FOREIGN PATENT DOCUMENTS

CN 1585842 2/2005
CN 103764886 4/2014
(Continued)

OTHER PUBLICATIONS

U.S. Appl. No. 13/602,745, "Final Office Action," dated May 16, 2016, 13 pages.
(Continued)

*Primary Examiner* — Alissa L Hoey
*Assistant Examiner* — Catherine M Ferreira
(74) *Attorney, Agent, or Firm* — Kilpatrick Townsend & Stockton LLP

(57) ABSTRACT

Rip-stop pants include waist and leg portions formed of ripstop fabric having synthetic mechanical-stretch filament yarns interwoven into spun, staple yarns in a ripstop pattern.

16 Claims, 2 Drawing Sheets

Related U.S. Application Data

(60) Provisional application No. 61/530,342, filed on Sep. 1, 2011.

(51) Int. Cl.

| | |
|---|---|
| ***D03D 15/56*** | (2021.01) |
| ***D03D 13/00*** | (2006.01) |
| ***D03D 15/47*** | (2021.01) |
| ***D03D 1/00*** | (2006.01) |
| ***D06B 1/00*** | (2006.01) |
| ***A41B 1/08*** | (2006.01) |
| ***A41D 1/06*** | (2006.01) |

(56) References Cited

U.S. PATENT DOCUMENTS

| | | | | |
|---|---|---|---|---|
| 6,689,461 | B2 | 2/2004 | Koyanagi et al. | |
| 6,805,957 | B1 | 10/2004 | Santos et al. | |
| 7,498,280 | B2 * | 3/2009 | DeBenedictis | B60R 21/235 280/728.1 |
| 9,637,845 | B2 | 5/2017 | Morales | |
| 2003/0092339 | A1 | 5/2003 | Covelli et al. | |
| 2003/0203690 | A1 | 10/2003 | Hess et al. | |
| 2003/0228812 | A1 * | 12/2003 | Stanhope | A41D 31/0022 442/49 |
| 2004/0055660 | A1 | 3/2004 | Heiman | |
| 2004/0209051 | A1 * | 10/2004 | Santos | F41H 3/00 428/195.1 |
| 2005/0109418 | A1 * | 5/2005 | Liao | D03D 15/08 139/420 R |
| 2006/0084337 | A1 * | 4/2006 | Corner | D02G 3/443 442/203 |
| 2006/0128243 | A1 * | 6/2006 | Kong | D03D 15/08 442/182 |
| 2006/0150610 | A1 | 7/2006 | Negola | |
| 2006/0228964 | A1 * | 10/2006 | Watkins | D06F 35/00 442/94 |
| 2007/0135009 | A1 * | 6/2007 | Liao | D03D 15/08 442/209 |
| 2009/0193584 | A1 * | 8/2009 | Stewart | A47G 9/0246 5/495 |
| 2009/0233507 | A1 | 9/2009 | Gross et al. | |
| 2011/0070412 | A1 | 3/2011 | Ly et al. | |
| 2011/0091412 | A1 | 4/2011 | Wittrup et al. | |
| 2013/0237110 | A1 | 9/2013 | Morales | |
| 2017/0231303 | A1 | 8/2017 | Morales | |

FOREIGN PATENT DOCUMENTS

| | | |
|---|---|---|
| EP | 2751320 | 7/2014 |
| HK | 1197279 | 1/2015 |
| JP | 07082629 | 3/1995 |
| JP | 2000008247 | 1/2000 |
| JP | 2002004145 | 1/2002 |
| WO | 03042438 | 5/2003 |
| WO | 2006088538 | 8/2006 |
| WO | 2013033719 | 3/2013 |

OTHER PUBLICATIONS

PCT/US2012/053696, "International Search Report and Written Opinion," dated Nov. 7, 2012.
Tortora et al., Fairchild's Dictionary of Textiles, 7th Edition, Fairchild Publications New York, Apr. 28, 2015.
CN 2012800425886, Notice on Grant of Patent Right for Invention, May 3, 2017, 4 pgs.
U.S. Appl. No. 13/602,745 , "Final Office Action", dated Jun. 25, 2015, 9 pages.
U.S. Appl. No. 13/602,745 , "Non-Final Office Action", dated Dec. 22, 2015, 11 pages.
U.S. Appl. No. 13/602,745 , "Non-Final Office Action", dated Dec. 19, 2014, 8 pages.
U.S. Appl. No. 13/602,745 , "Notice of Allowance", dated Jan. 9, 2017, 10 pages.
13/602,74505/16 , "Final Office Action", dated May 16, 2016, 13 pages.
U.S. Appl. No. 15/464,179 , "Final Office Action", dated Dec. 26, 2017, 12 pages.
U.S. Appl. No. 15/464,179 , "Non-Final Office Action", dated Jun. 2, 2017, 12 pages.
CN201280042588.6 , "Office Action", dated Oct. 8, 2014, 15 pages.
CN201280042588.6 , "Office Action", dated Jul. 1, 2015, 17 pages.
CN201280042588.6 , "Office Action", dated Oct. 9, 2016, 17 pages.
CN201280042588.6 , "Office Action", dated Jan. 21, 2016, 22 pages.
CN2012800425886 , "Notice on Grant of Patent Right for Invention", May 3, 2017, 4 pages.
Congyang et al., "Discussion on Dyeing and Finishing of T-400 Polyurethane Interwoven Fabric", Dyeing and Finishing Technology, vol. 28, No. 6, Jun. 2006, pp. 20-22.
PCT/US2012/053696 , "International Search Report and Written Opinion", dated Nov. 7, 2012, 10.
Tortora et al., Fairchild's Dictionary of Textiles, 7th Edition, Fairchild Publications New York, Apr. 28, 2015, 3 pages.
Xiaojin , "Dyeing and Finishing of Bamboo Fiber Polyurethane/T-400 Dual Elastic Fabrics", Printing and Dyeing, No. 24, Nov. 2007, pp. 13-15.
Yan et al., "Development of Functional T-400 Yarn-Dyed Fabric and Comparison of Wearability", Scientific Research and Practice, No. 1, Article No. 1672, Mar. 2006, pp. 1-3.
U.S. Appl. No. 15/464,179 , "Advisory Action", dated Apr. 11, 2018, 4 pages.
MX/a/2014/002279, Office Action, dated Nov. 22, 2017, 4 pages.
EP12762476.5, "Office Action", dated Jul. 11, 2019, 3 pages.
U.S. Appl. No. 15/858,558, "Non-Final Office Action", dated Nov. 12, 2019, 8 pages.
U.S. Appl. No. 15/858,558, Advisory Action, dated Nov. 4, 2020, 3 pages.
U.S. Appl. No. 15/858,558, Final Office Action, dated Aug. 17, 2020, 11 pages.
Application No. EP12762476.5, Office Action, dated May 7, 2020, 4 pages.
U.S. Appl. No. 15/858,558, Non-Finai Office Action, dated Sep. 21, 2021, 13 pages.

* cited by examiner

PANTS WITH RIP-STOP AND MECHANICAL STRETCH

This application is a continuation of U.S. application Ser. No. 13/602,745, filed Sep. 4, 2012, which application claims the benefit of U.S. Provisional Application No. 61/350,342, filed Sep. 1, 2011, the entire contents of each of which are hereby incorporated by reference in their entirety for all purposes.

BACKGROUND

Rip-stop woven fabrics are commonly used for military and police uniforms and most rip-stop fabrics used for police and military uniforms are made in blends of polyester/cotton, cotton/polyester, and nylon/cotton. The strength, ease of care, and fade-resistance properties of rip-stop fabrics for police and military uniforms have been enhanced by this blending of polyester or nylon with cotton. Stain and water resistant finishes can be applied to the fabrics to further improve durability and ease of care.

A key requirement for rip-stop fabrics used for police and military uniforms is for them to be able to withstand 50+ washes and extensive field used while still delivering comfort to the wearer. Therefore, durability and comfort become the two most important attributes of these fabrics.

A very popular way to add comfort to a fabric is by adding stretch. Commonly, stretch has been added to fabrics by using elastic fibers, such as spandex or elastane fibers. Spandex fibers present technical challenges when used in fabrics with a polyester content higher than 40%, because spandex fiber degrades during the dyeing process as the polyester is dyed at higher temperatures than cotton or other cellulosic-based materials. In addition, spandex fibers can further degrade when stain repellant finishes are added to the fabric as they are heat-set during the finishing stage.

Further, the extensive washing cycles that police and military uniforms go through further degrade the spandex in fabric, reducing the usable life of the fabric. As a result, all the rip-stop fabrics made for police and military uniforms today that are made in polyester/cotton or nylon/cotton blends do not offer stretch properties.

BRIEF SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

Embodiments herein are directed to a rip-stop fabric incorporating mechanical stretch fibers, as opposed to elastic stretch fibers such as spandex.

In embodiments, the rip-stop woven fabric made with at least two type of yarns. The first yarn is spun from an intimate blend of staple/commercially-available fibers, with one of the fibers being cellulose-based (e.g., cotton or rayon) and the other fiber being polyester, nylon, or modacrilic. The second yarn is a filament multi-component polyester yarn or elasterell-p multi-component filament yarn.

For a fuller understanding of the nature and advantages of the present invention, reference should be made to the ensuing detailed description and accompanying drawings.

DETAILED DESCRIPTION

In the following description, various embodiments of the present invention will be described. For purposes of explanation, specific configurations and details are set forth in order to provide a thorough understanding of the embodiments. However, it will also be apparent to one skilled in the art that the present invention may be practiced without the specific details. Furthermore, well-known features may be omitted or simplified in order not to obscure the embodiment being described.

Embodiments herein are directed to a rip-stop fabric that features the combination of mechanical stretch, rip-stop weave, and fade resistance.

The rip-stop woven fabric is made with at least two type of yarns. The first yarn is spun from an intimate blend of staple/commercially-available fibers, with one of the fibers being cellulose-based (e.g., cotton or rayon) and the other fiber being polyester, nylon, or modacrilic (hereinafter "spun fibers" or "spun yarns"). The second yarn is a filament multi-component polyester yarn or elasterell-p multi-component filament yarn (hereinafter "multi-component polyester filament yarns" or "multi-component polyester filament fibers"), filament multi-component yarn being distinguishable from elastic or other covered yarns by lacking a sheathe or covering companion fiber. Such multi-component polyester filament yarns provide a mechanical stretch property for the rip-stop fabric.

Elasterell, or elasterell-p is a specific subclass of inherently elastic, multi-component polyester filament fibers. The U.S. Federal Trade Commission defines "elasterell-p" as fiber formed by the interaction of two or more chemically distinct polymers (of which none exceeds 85% by weight) which contains ester groups as the dominant functional unit (at least 85% by weight of the total polymer content of the fiber) and which, if stretched at least 100%, durably and rapidly reverts substantially to its unstretched length when the tension is removed. Although elasteral-p is described in embodiments, other multi-component polyester filament yarns may be used.

The multi-component filament yarn adds stretch properties to the rip-stop fabric while being able to withstand high dyeing and finishing temperatures, thereby eliminating the need to use spandex and overcoming the durability limitations of spandex.

Figure 1:
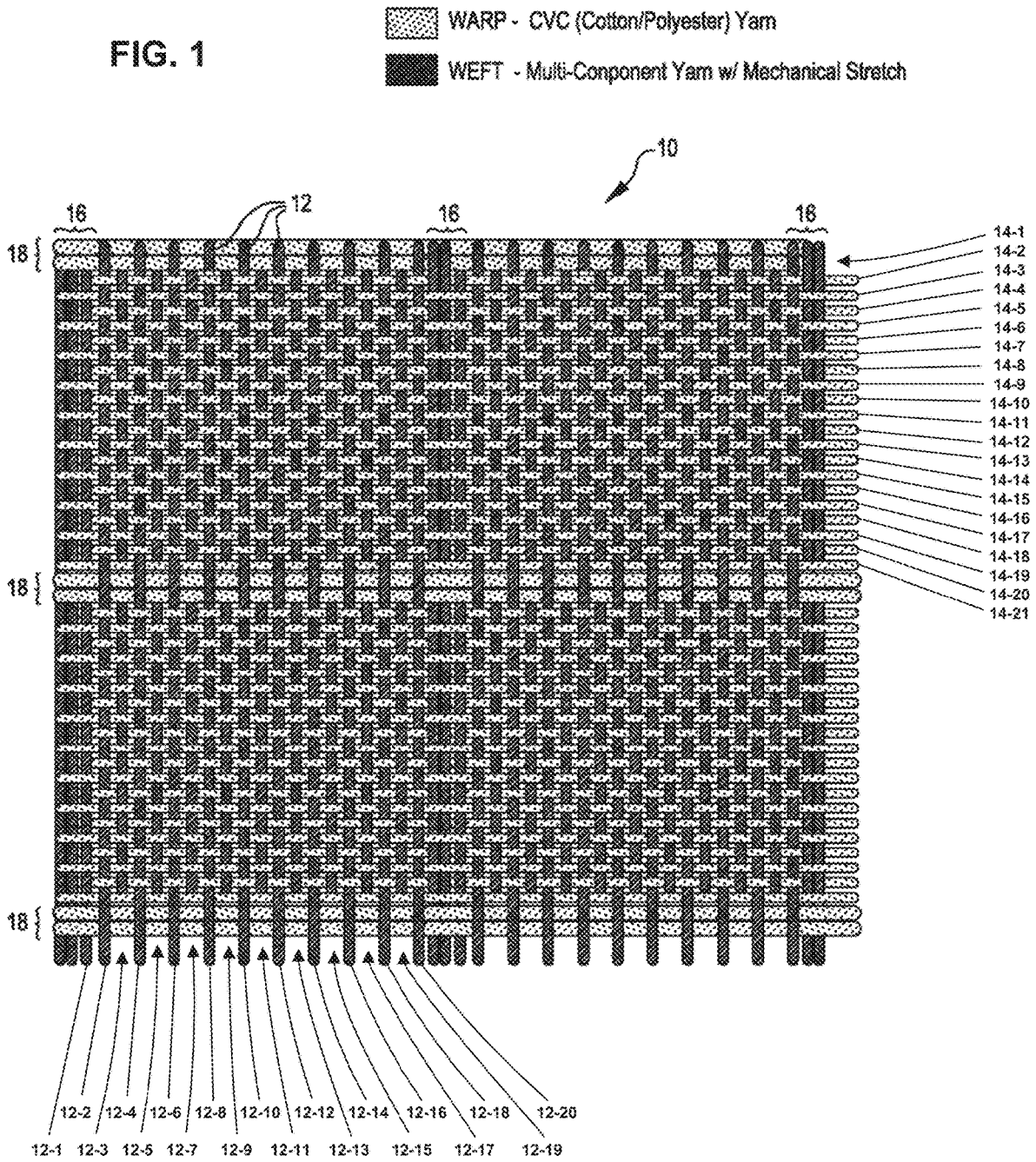
FIG. 1 is a representation of a fabric in accordance with embodiments.

In embodiments, a woven rip-stop fabric 10 (FIG. 1) is formed by weaving multi-component polyester filament weft yarns 12 into spun warp yarns 14. As shown in FIG. 1, the woven rip-stop fabric 10 consists of the multi-component polyester filament weft yarns 12 and the spun warp yarns 14. As shown in FIG. 1, to provide a rip-stop fabric weave, the multi-component polyester filament yarns 12 are interwoven through spun yarns 14 in a plain weave fashion. However, to provide strength and rip resistance, after predetermined intervals, two or more multi-component polyester filament yarns 12 are woven together (instead of each yarn alternating, as in regular plain weave) in the same pattern through the weft yarns. Such a variation in the pattern is shown generally at the areas 16 in FIG. 1. The pattern of weaving multiple (at least 2) adjacent weft yarns in the same weaving direction through the warp yarns is done in regular intervals. Similarly, the same one or more warp yarns may be skipped by each weft yarn during the weaving process, causing multiple spun warp yarns 12 to extend together, as shown generally at the areas 18 of the fabric 10 in FIG. 1. The pattern of weaving multiple adjacent weft yarns in the same weaving direction and skipping at least one weft yarn consistently during weaving can be done in regular intervals, providing a crosshatch pattern in the weave. The intervals are typically 3 to 8 millimeters, but may be altered to provide a desired function. In embodiments, the interval pattern in the weft direction is the same as the warp direction, so that the crosshatch forms repeating squares.

Alternatively, the multi-component polyester filament yarns 12 may be used as the warp yarns, and the spun fibers 14 may be used as the weft yarns and woven into the multi-component polyester filament yarns, forming a ripstop pattern.

The woven rip-stop fabric 10 illustrated in FIG. 1 includes spun yarns 14 and mechanical stretch yarns 12 interwoven into the spun yarns 14 in a plain weave pattern. The spun yarns 14 include twelve of the spun yarns arranged sequentially from a first yarn 14-1 to a twelfth yarn 14-12 of the spun yarns 14. The mechanical stretch yarns 12 include twelve of the mechanical stretch yarns arranged sequentially from a first yarn 12-1 to a twelfth yarn 12-12 of the mechanical stretch yarns 12. Each of the first, third, fifth, seventh, ninth, and eleventh yarns of the twelve of the mechanical stretch yarns passes under each of the first, third, fifth, seventh, ninth, and eleventh yarns of the twelve of the spun yarns, and over each of the second, fourth, sixth, eighth, tenth, and twelfth yarns of the twelve of the spun yarns. The woven rip-stop fabric 10 illustrated in FIG. 1 further includes: (a) an additional mechanical stretch yarn that is woven together with a yarn of the twelve of the mechanical stretch yarns, and (b) an additional spun yarn is woven together with a yarn of the twelve of the spun yarns. The mechanical stretch yarns consist of multi-component polyester yarns or elasterell-p multi-component filament yarns.

After weaving, a stain and oil repellant finish is added during the finishing process to improve fade resistance and protect the woven fabric from stains. Again, the mechanical stretch properties of the fabric, as contrasted with the more common use of spandex in stretch fabrics, enables the rip-stop fabric of the present disclosure to withstand the high temperatures involved in this finishing process.

Figure 2:
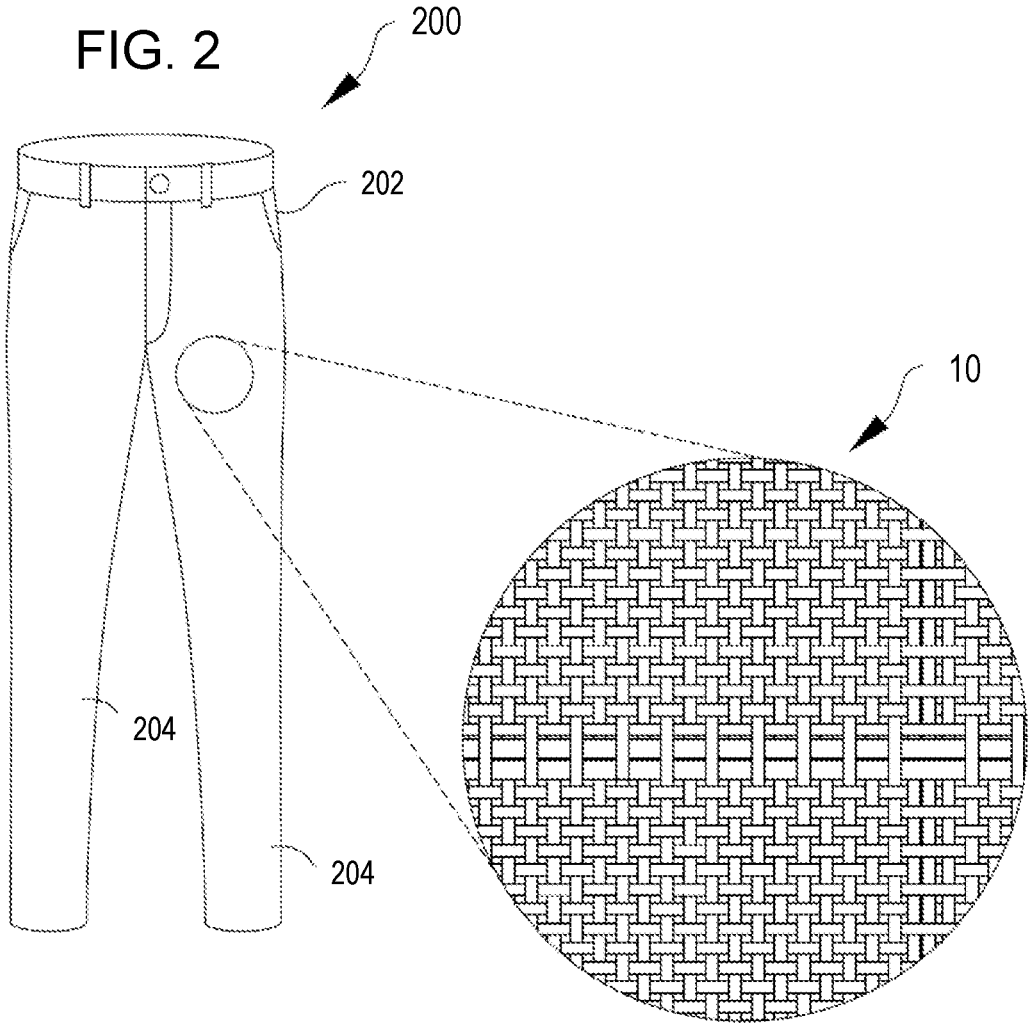
FIG. 2 is a representation of pants including the fabric of FIG. 1.

The novel ripstop fabric described herein provides a fabric that can last many washes and that is highly suitable for police and military/militia wear, including pants (e.g., pants 200, FIG. 2) or shirts. The pattern is resistant to wear, is capable of stretching for comfort, and can withstand multiple washes. Pants 200 include a waist portion 202 and leg portions 204 formed of the rip stop fabric 10 as shown in FIG. 2.

Other variations are within the spirit of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

All references, including publications, patent applications, and patents, cited herein are hereby incorporated by reference to the same extent as if each reference were individually and specifically indicated to be incorporated by reference and were set forth in its entirety herein.

What is claimed is:

1. Pants comprising:

a waist portion; and leg portions, wherein at least one of the waist portion or the leg portions comprises a ripstop fabric, wherein the ripstop fabric comprises:

spun yarns and mechanical stretch yarns interwoven into the spun yarns in a plain weave pattern in which:

the spun yarns comprise twelve of the spun yarns arranged sequentially from a first yarn to a twelfth yarn of the spun yarns;

the mechanical stretch yarns comprise twelve of the mechanical stretch yarns arranged sequentially from a first yarn to a twelfth yarn of the mechanical stretch yarns; and each of the first, third, fifth, seventh, ninth, and eleventh yarns of the twelve of the mechanical stretch yarns passes under each of the first, third, fifth, seventh, ninth, and eleventh yarns of the twelve of the spun yarns, and over each of the second, fourth, sixth, eighth, tenth, and twelfth yarns of the twelve of the spun yarns;

an additional mechanical stretch yarn that is woven together with a yarn of the twelve of the mechanical stretch yarns; and an additional spun yarn is woven together with a yarn of the twelve of the spun yarns, wherein the mechanical stretch yarns consist of multi-component polyester yarns or elasterell-p multi-component filament yarns.

2. The pants of claim 1, wherein:

the ripstop fabric comprises war yarns and weft yarns that are interwoven in the plain weave pattern;

the warp yarns comprise the spun yarns; and the weft yarns consist of the mechanical stretch yarns.

3. The pants of claim 1, wherein:

the ripstop fabric comprises warp yarns and weft yarns that are interwoven in the plain weave pattern;

the weft yarns comprise the spun yarns; and the warp yarns consist of the mechanical stretch yarns.

4. The pants of claim 1, wherein:

the ripstop fabric comprises warp yarns and weft yarns that are interwoven in the plain weave pattern;

one of the warp yarns or the weft yarns comprise the spun yarns;

the other of the warp yarns or the weft yarns consist of the mechanical stretch yarns; and repeated instances of two or more of the mechanical stretch yarns are woven together through the spun yarns in regular first ripstop intervals.

5. The pants of claim 4, wherein repeated instances of two or more of the spun yarns are woven together through the mechanical stretch yarns in regular second ripstop intervals.

6. The pants of claim 5, wherein each of the regular first ripstop intervals and each of the regular second ripstop intervals is in a range from 3 to 8 millimeters.

7. The pants of claim 1, further comprising at least one of a water, stain, or an oil repellant finish that is applied to the ripstop fabric during a finishing process.

8. Police clothing comprising the pants of claim 1.

9. Military clothing comprising the pants of claim 1.

10. The pants of claim 1, wherein the mechanical stretch yarns consist of multi-component polyester filaments.

11. The pants of claim 1, wherein the mechanical stretch yarns consist of elasterell-p multi-component filament yarns.

12. The pants of claim 1, wherein the spun yarns comprise at least one synthetic fiber possessing similar dye retention properties as the mechanical stretch yarns.

13. The pants of claim 1, wherein the ripstop fabric comprises a fade-resistant polyester dye.

14. The pants of claim 1, wherein the spun yarns comprise an intimate blend of a cellulosic fiber and a synthetic fiber.

15. The pants of claim 1, wherein the ripstop fabric comprises a stain resistant finish.

16. The pants of claim 1, wherein the ripstop fabric comprises a water resistant finish.

* * * * *